US012305638B2

(12) United States Patent
Stoessel et al.

(10) Patent No.: US 12,305,638 B2
(45) Date of Patent: May 20, 2025

(54) GEAR PUMP AND DRIVE MACHINE

(71) Applicant: Valeo Powertrain GmbH, Ebern (DE)

(72) Inventors: Roland Stoessel, Ebern (DE); Kevin Heider, Ebern (DE); Christian Sperber, Ebern (DE)

(73) Assignee: Valeo Powertrain GmbH, Ebern (DE)

( * ) Notice: Subject to any disclaimer, the term of this patent is extended or adjusted under 35 U.S.C. 154(b) by 189 days.

(21) Appl. No.: 17/805,516

(22) Filed: Jun. 6, 2022

(65) Prior Publication Data

US 2022/0403843 A1 Dec. 22, 2022

(30) Foreign Application Priority Data

Jun. 22, 2021 (DE) ..... 10 2021 116 160.6

(51) Int. Cl.
*F04C 15/00* (2006.01)
*F04C 2/08* (2006.01)

(52) U.S. Cl.
CPC ..... *F04C 15/0057* (2013.01); *F04C 2/084* (2013.01); *F04C 15/0088* (2013.01);
(Continued)

(58) Field of Classification Search
CPC .... F04C 11/001; F04C 14/02; F04C 15/0057; F04C 15/0088; F04C 2/084; F04C 2/18; F04C 2230/60; F04C 2240/30; F04C 2240/40; F04C 2240/60; Y10T 74/19633; Y10T 403/7098
(Continued)

(56) References Cited

U.S. PATENT DOCUMENTS 2,750,891 A * 6/1956 Berry ..... F01C 11/002 418/7
2,965,036 A * 12/1960 Wood ..... F04C 14/02 418/200
(Continued)

FOREIGN PATENT DOCUMENTS

CN 110360098 A 10/2019
DE 1 273 328 A 7/1968
(Continued)

OTHER PUBLICATIONS

German Search Report issued Apr. 1, 2022 in German Application 10 2021 116 160.6 filed on Jun. 22, 2021, 8 pages (with English Translation of Categories of Cited Documents & Written Opinion).
(Continued)

*Primary Examiner* — Charles G Freay
*Assistant Examiner* — Benjamin Doyle
(74) *Attorney, Agent, or Firm* — Oblon, McClelland, Maier & Neustadt, L.L.P.

(57) ABSTRACT

A gear pump having a drive shaft and at least two gear wheel pairs which each include a drive gear wheel and a driven gear wheel. The two gear wheels of a gear wheel pair are in meshing engagement with one another, and the drive gear wheels are arranged on the drive shaft and in torque-transmissive engagement with the drive shaft. The gear pump has a freely rotatably mounted shaft on which the driven gear wheels of the gear wheel pair are arranged in torque-transmissive engagement, wherein the driven gear wheels are mounted on the freely rotatably mounted shaft by means of a clearance fit.

10 Claims, 4 Drawing Sheets

(52) U.S. Cl.
CPC ..... *F04C 2240/30* (2013.01); *F04C 2240/40* (2013.01); *F04C 2240/60* (2013.01)

(58) Field of Classification Search
USPC ..... 417/410.4; 74/411; 403/383
See application file for complete search history.

(56) References Cited

U.S. PATENT DOCUMENTS 2,993,450 A * 7/1961 Weigert ..... F04C 2/086 418/71
3,137,238 A * 6/1964 Gordon ..... F04C 15/0026 418/206.7
3,370,540 A * 2/1968 Carpenter ..... F04C 11/001 417/420
3,576,379 A * 4/1971 Parise ..... F04C 11/008 417/410.4
3,852,004 A * 12/1974 Foster ..... F04C 15/0019 418/71
3,881,849 A * 5/1975 Commarmot ..... F04C 2/084 415/217.1
4,231,726 A * 11/1980 Cobb ..... F04C 2/084 418/206.5
4,259,045 A * 3/1981 Teruyama ..... F04C 11/001 29/888.023
4,631,973 A * 12/1986 Eley ..... F16D 1/06 403/375
5,324,183 A * 6/1994 Capelle ..... F04C 13/002 418/102
6,213,745 B1 * 4/2001 Woodcock ..... F04C 15/0088 418/206.7
6,612,821 B1 * 9/2003 Kuijpers ..... F04C 15/0038 418/206.1
7,309,218 B1 * 12/2007 Lewis ..... F04C 2/18 417/410.4
7,806,673 B2 * 10/2010 Muscarella ..... F04C 15/0088 418/206.8
8,496,457 B2 * 7/2013 Varga ..... F04C 14/28 418/200
9,611,847 B2 * 4/2017 Martin-Dye ..... F04C 2/086
10,982,670 B2 * 4/2021 Claywell ..... F04C 2/18
2004/0179953 A1 * 9/2004 Suzuki ..... F04C 2/086 417/310
2004/0213680 A1 * 10/2004 Suzuki ..... F04C 14/02 417/310
2005/0112012 A1 * 5/2005 Marheineke ..... F02M 37/041 74/457
2005/0196301 A1 * 9/2005 Iwasaki ..... F04C 15/0034 417/410.3
2006/0090579 A1 * 5/2006 Lincoln ..... F04C 2/084 74/10.8
2007/0237666 A1 * 10/2007 O'Brien, II ..... F04C 2/102 418/191
2008/0240968 A1 * 10/2008 Chiu ..... F04C 2/18 418/206.7
2010/0150764 A1 * 6/2010 Simonelli ..... F04C 2/086 418/191
2012/0242140 A1 * 9/2012 Koizumi ..... B60T 8/4031 418/140
2015/0330387 A1 * 11/2015 Morselli ..... F01C 1/082 418/206.5
2016/0108914 A1 * 4/2016 Ramadoss ..... F04C 2/18 418/191
2016/0265526 A1 * 9/2016 Saito ..... F04C 15/0049
2016/0341265 A1 * 11/2016 Heubner ..... F16D 25/12
2017/0009771 A1 * 1/2017 Reul ..... F04D 29/026
2017/0210219 A1 * 7/2017 Butts ..... B60K 6/12
2018/0045198 A1 * 2/2018 Briere ..... F04C 2/18
2019/0162182 A1 * 5/2019 McGowan ..... F04C 2/18
2020/0010072 A1 * 1/2020 Iwakura ..... F16H 61/0025
2022/0099090 A1 * 3/2022 Claywell ..... F01C 21/108
2022/0243803 A1 * 8/2022 Böhm ..... F16H 57/0436

FOREIGN PATENT DOCUMENTS

DE 1 18 695 A1 3/1976
DE 101 59 088 A1 6/2003
DE 10 2012 216 122 A1 4/2013

OTHER PUBLICATIONS

Extended European Search Report issued on Nov. 21, 2022 in European Patent Application No. 22178908.4, 7 pages.
European Office Action issued in European Patent Application No. 22 178 908.4 on Oct. 17, 2024.

* cited by examiner

GEAR PUMP AND DRIVE MACHINE

The invention concerns a gear pump, in particular for dry sump lubrication of a drive train in a motor vehicle, and a drive machine with a gear pump. For example, the gear pump is a multiple gear pump.

Gear pumps for dry sump lubrication usually comprise several pump stages, wherein one pump stage forms a pressure pump stage which conveys lubricating oil from a lubricating oil reservoir to the lubrication points of the drive machine and transmission, and at least one further pump stage is configured as a suction pump stage which returns lubrication oil, dripping from the lubrication points, from the oil sump of the drive machine to the oil reservoir.

One disadvantage of known gear pumps is that disruptive noise can occur because of pressure pulsations.

Also, the known gear pumps are sometimes complex to assemble, in particular when the driven gear wheels are mounted so as to be freely rotatable.

If the driven gear wheels are fixedly pressed onto a shaft, the gear wheels must be produced to particularly precise dimensions, whereby manufacturing is complex and cost-intensive. Also, a precisely positioned press fit is necessary.

It is therefore an object of the invention to provide an optimised gear pump with several gear wheel pairs on common shafts.

This object is achieved according to the invention by a gear pump having a drive shaft and at least two gear wheel pairs which each comprise a drive gear wheel and a driven gear wheel, wherein the two gear wheels of a gear wheel pair are in meshing engagement with one another, and wherein the drive gear wheels are arranged on the drive shaft and in torque-transmissive engagement with the drive shaft, and having a freely rotatably mounted shaft on which the driven gear wheels of the gear wheel pair are arranged in torque-transmissive engagement, wherein the driven gear wheels are mounted on the freely rotatably mounted shaft by means of a clearance fit.

In this way, a pre-positioning of the gear wheels on the drive shaft or the freely rotatably mounted shaft can be achieved, which is advantageous for assembly.

The pre-positioning takes place in particular by means of a shaft and hub profile.

In particular, the individual gear wheels can be pre-mounted on the shaft at a defined angular position relative to one another.

The driven gear wheels are in particular guided radially by means of the clearance fit.

The driven gear wheels are in particular driven by the drive gear wheels.

Preferably, the teeth of the gear wheels on one shaft are not arranged in a line.

With this arrangement, the pressure pulsations in the oil supply system can be reduced and also the drive torque of the multiple gear pump can be smoothed out.

Because of the play of the driven gear wheels on the freely rotatably mounted shaft, it is possible to mount the driven gear wheels on a continuous shaft in a defined angular position, wherein the play allows a certain tolerance compensation so that all gear wheel pairs are in engagement with one another such that the tooth flanks roll on one another. Without the play, e.g. with a press fit, the tolerances to be observed would be very tight, which would lead to a very great complexity in production.

According to one embodiment, one of the gear wheel pairs forms a pressure pump stage, and the other gear wheel pairs each form a suction pump stage.

The drive gear wheels on the drive shaft may also be mounted by means of a clearance fit, wherein the driven gear wheels on the freely rotatably mounted shaft have a greater twist play than the drive gear wheels on the drive shaft. Because the drive gear wheels are mounted by means of a clearance fit, the drive gear wheels can be pushed onto the drive shaft particularly easily, which also contributes to simple assembly.

The drive shaft and/or the freely rotatably mounted shaft preferably has at least one flattening which extends in the longitudinal direction of the respective shaft. For example, the shafts have a so-called double-D profile, i.e. two parallel flattenings. The flattening serves for torque transmission. A torque-transmissive engagement can be implemented particularly easily by means of a flattening.

According to one embodiment, a step is formed on the drive shaft, wherein a drive gear wheel lies against the step in the axial direction. In this way, when the drive gear wheel is pushed onto the drive shaft, a defined axial positioning of the gear wheel on the drive shaft can be achieved.

Alternatively or additionally, a notch may be formed in the drive shaft, wherein a locking ring is arranged in the notch and axially fixes a drive gear wheel on the drive shaft. In this way, an axial positioning of the gear wheel on the drive shaft can also be achieved.

For example, a drive gear wheel on the drive shaft lies with one end face against the step and with the further end face against the locking ring.

An end face of the drive gear wheel may serve as a stop for axial positioning of the drive shaft. In this way, further bearing elements may be omitted, whereby the gear pump can be designed particularly compactly and economically.

The gear pump is preferably driven electrically by means of an electric motor. This allows operation of the gear pump independently of the drive of the drive machine.

The electric motor in particular drives the drive shaft.

Preferably, the electric motor is accommodated in a housing and the end face of a drive gear wheel lies against a flange of the housing. The housing or flange, together with the drive gear wheel, thus serves for axial position of the drive shaft.

For example, all drive gear wheels and/or all driven gear wheels have the same profile, wherein the profile is not axially symmetrical. If the gear wheels are mounted alternately forward and backward on a shaft, a phase offset between the gear wheels is achieved in a particularly simple fashion. By use of gear wheels with the same profile, the production cost is also reduced.

A phase offset between the gear wheels is advantageous with respect to reducing vibration and disruptive noise. More precisely, the phase offset of the gear wheels achieves a phase shift of pressure pulses.

The gear wheel pairs may be accommodated in a housing, wherein the housing has at least one partition wall which separates the two gear wheel pairs from one another in the axial direction and serves as an axial stop for at least one of the two gear wheel pairs. In this way, the gear wheels separated by the partition wall are axially positioned on the respective shaft by means of the partition wall.

The object is furthermore achieved according to the invention by a drive machine for a motor vehicle having a gear pump as described above and having an oil reservoir, wherein the gear pump is configured to convey oil from the oil reservoir to lubrication points in the drive machine and to return the lubricating oil, dripping from the lubrication points, to the oil reservoir.

The drive machine may be an electric drive, a hybrid drive or an internal combustion engine.

Further advantages and features of the invention will emerge from the following description and from the appended drawings, to which reference is made. In the drawings:

FIG. 1 shows a gear pump 10 for dry sump lubrication of a drive machine.

Figure 1:
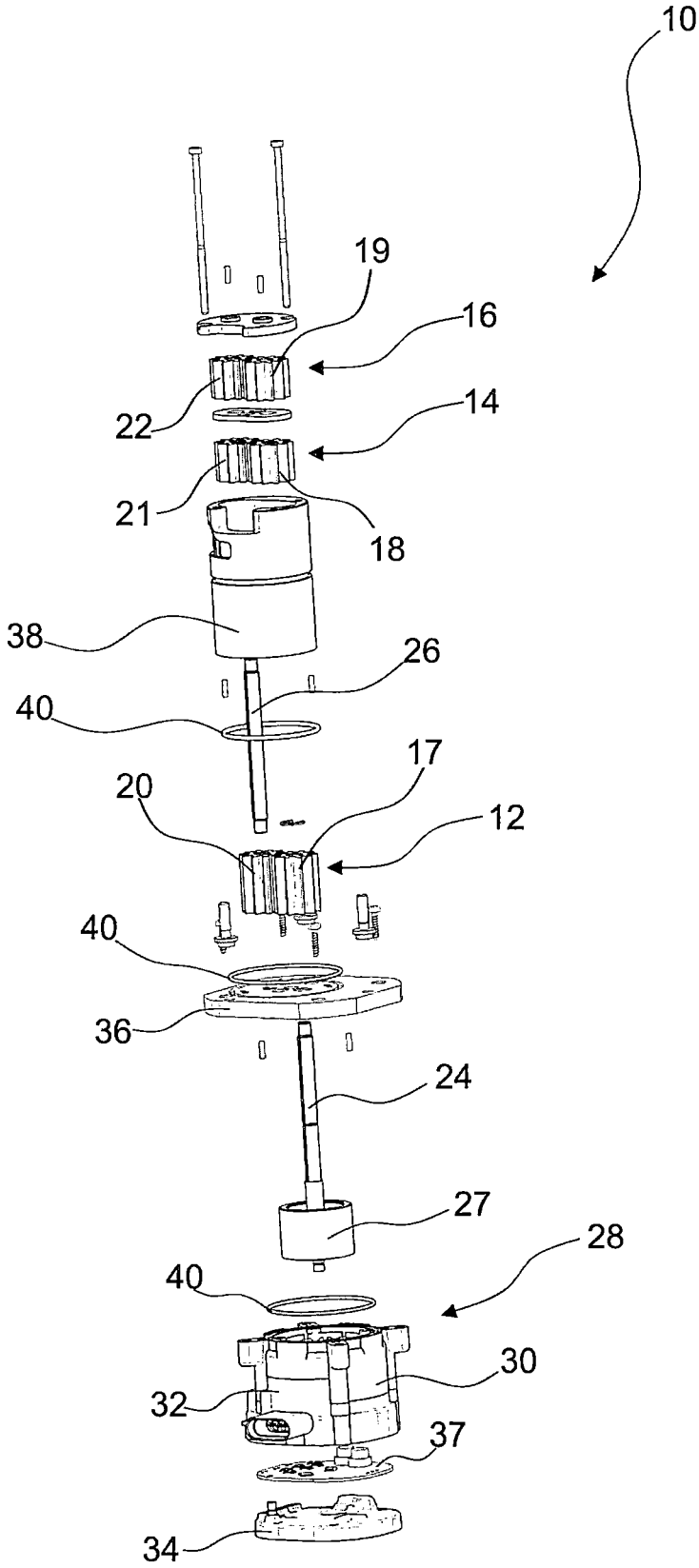
FIG. 1 shows a gear pump according to the invention in an exploded view.

The gear pump 10 has several pump stages, in this exemplary embodiment a pressure pump stage and two suction pump stages.

The stages are each formed by gear wheel pairs 12, 14, 16.

Each gear wheel pair 12, 14, 16 comprises a drive gear wheel 17, 18, 19 and a driven gear wheel 20, 21, 22.

The gear wheels 17, 18, 19, 20, 21, 22 may be made of sintered steel or a precisely shaped, chemically and thermally resistant plastic.

The two gear wheels of a gear wheel pair 12, 14, 16 are in meshing engagement with one another.

The drive gear wheels 17, 18, 19 are arranged on a drive shaft 24 and in torque-transmissive engagement with the drive shaft 24.

The driven gear wheels 20, 21, 22 are arranged on a freely rotatably mounted shaft 26.

The drive shaft 24 is driven by a rotor 27 of an electric motor 28.

The rotor 27 is accommodated in a housing 30 which comprises a housing part 32 with a stator 33, a cover 34 and a flange 36.

The gear pump 10 comprises an electronic controller, for example in the form of a circuit board 37, in order to control the electric motor 28 of the gear pump 10 and in some cases further electronic components.

The gear wheel pairs 12, 14, 16 are accommodated in an additional housing part 38 which adjoins the flange 36.

The housing part 32, 38, the cover 34 and flange 36 are sealed relative to one another by means of O-rings 40. Alternatively, the cover 34 may be replaced by an electronic casting compound.

Figure 2:
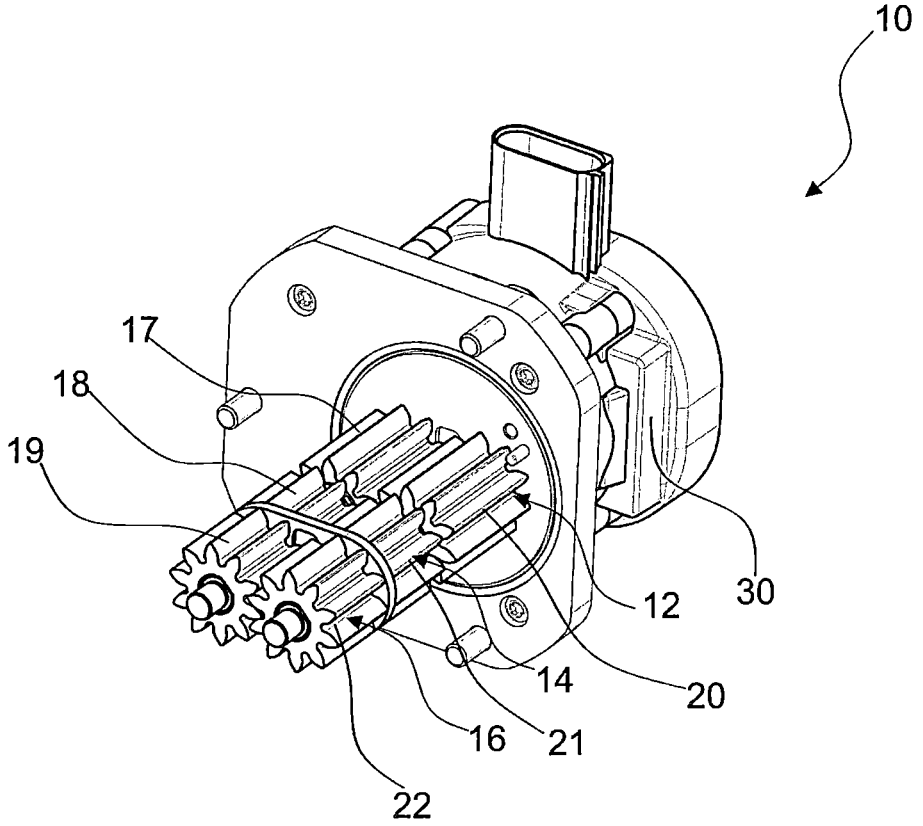
FIG. 2 shows a perspective illustration of the gear pump from FIG. 1.

FIG. 2 shows a part of the gear pump 10 from FIG. 1 in a perspective view.

The housing 38 has been removed in FIG. 2 to allow a better view of the gear wheel pairs 12, 14, 16. In particular, the meshing engagement of the gear wheels 17, 18, 19, 20, 21, 22 can be seen.

Figure 3:
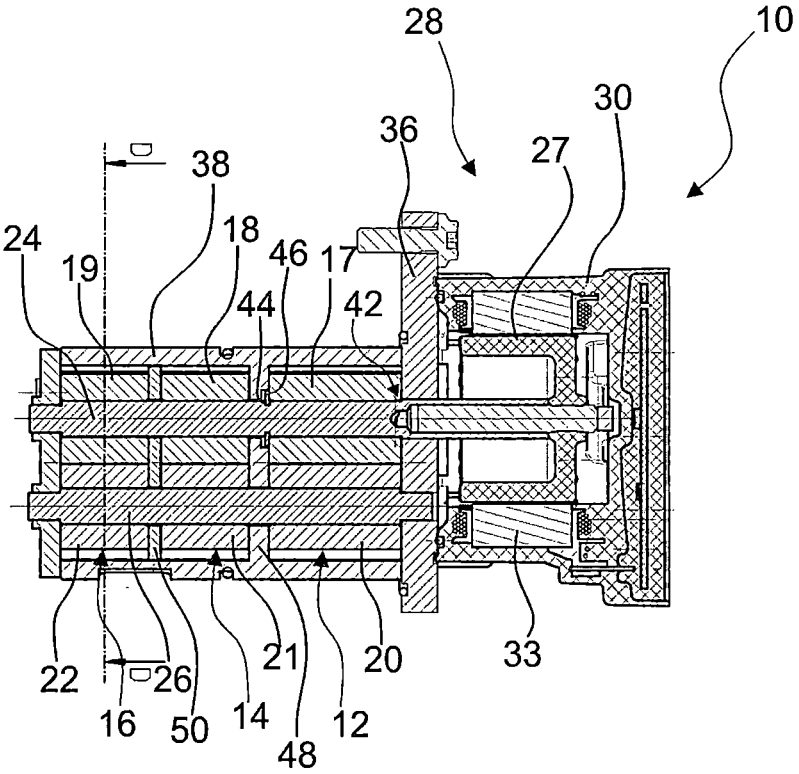
FIG. 3 shows a longitudinal section through the gear pump from FIG. 1.

FIG. 3 shows a longitudinal section through the gear pump 10.

The sectional illustration shows that a step 42 is formed on the drive shaft 24, wherein one of the drive gear wheels, namely the drive gear wheel 17 which is closest to the rotor 27, lies against the step 42.

Furthermore, a notch 44 is formed in the drive shaft 24, and a locking ring 46 is arranged therein.

The locking ring 46 and the step 42 axially fix the drive gear wheel 17.

The axially fixed drive gear wheel 17 lies with one end face against the flange 36 of the housing 30 of the electric motor 28.

In this way, the end face of the drive gear wheel 17 serves for axial positioning of the drive shaft 24.

FIG. 3 also shows that the housing 38 has a partition wall 48 which separates the gear wheel pairs 12, 14 axially from one another.

Also, the partition wall 48 serves as an axial stop for the gear wheel pair 14, so that this is axially positioned on the shaft by the partition wall 48.

The other gear wheel pair 16 is separated from the gear wheel pair 14 by a spacer 50.

Figure 4:
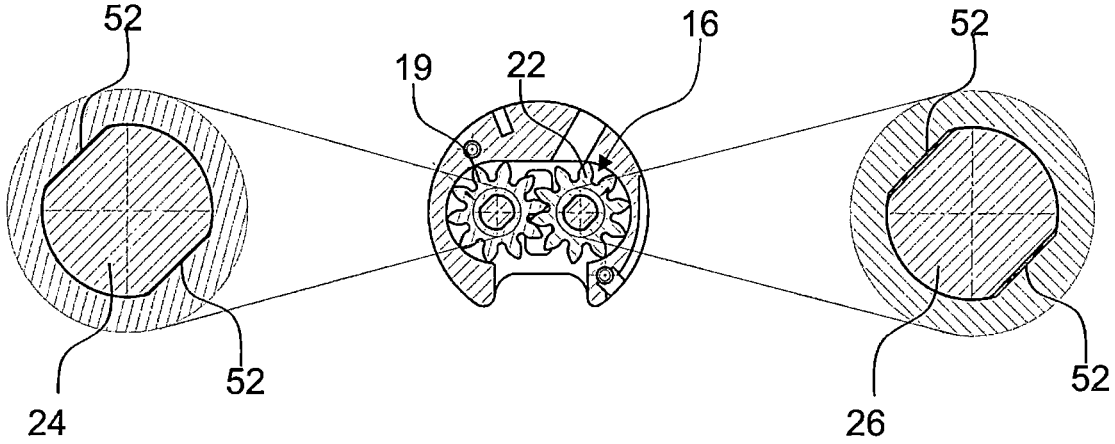
FIG. 4 shows a cross-section through the gear pump from FIG. 1.

FIG. 4 shows a cross-section through the gear pump in the region of the gear wheel pair 16 along line D-D in FIG. 3. The regions around the shaft 24, 26 are each shown enlarged in a detail view.

The gear wheels 19, 22 are in torque-transmissive engagement with the drive shaft 24 or the freely rotatably mounted shaft 26 respectively.

The torque-transmissive engagement is achieved in that the drive shaft 24 and/or the freely rotatably mounted shaft 26 each have two flattenings 52 which extend in the longitudinal direction of the respective shaft 24, 26.

In particular, the shafts 24, 26 each have a double-D profile.

The gear wheels 19, 22 are mounted by means of a clearance fit on both the drive shaft 24 and also on the freely rotatably mounted shaft 26.

The driven gear wheel 22 on the freely rotatably mounted shaft 26 has however a greater twist play than the drive gear wheel 19 on the drive shaft 24.

The gear wheels 17, 18, 20, 21 of the other gear wheel pairs 12, 14 are mounted in the same fashion.

Figure 5:
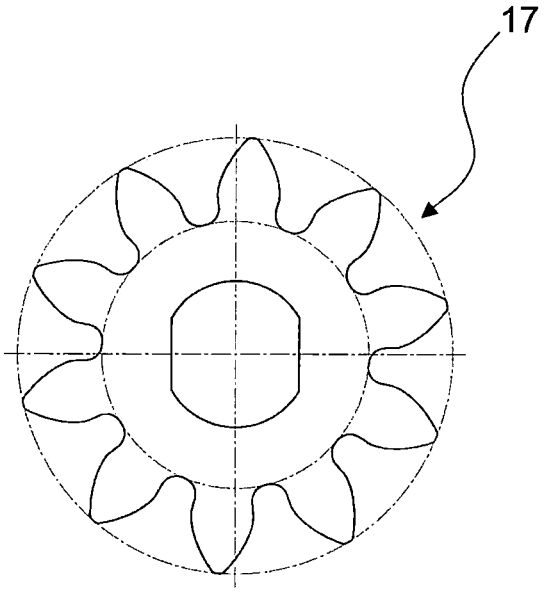
FIG. 5 shows a cross-section through a gear wheel.

FIG. 5 shows a cross-section through a single gear wheel, for example the gear wheel 17.

For example, all gear wheels 17, 18, 19, 20, 21, 22 have the same profile.

The profile of the gear wheels 17, 18, 19, 20, 21, 22 is not axially symmetrical.

Figure 6:
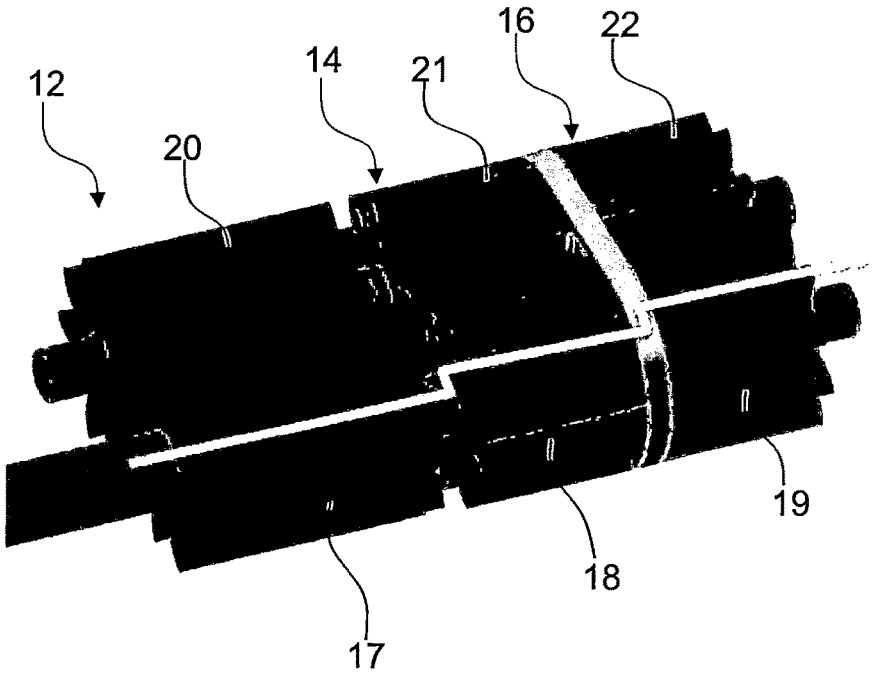
FIG. 6 shows the gear wheels of the gear pump according to the invention.

If the gear wheels are mounted alternately forward and backward on a shaft 24, 26, i.e. such that the teeth of adjacent gear wheels do not run in a line, a phase offset is thus achieved between the gear wheels 17, 18, 19, 20, 21, 22 of the adjacent gear wheel pairs 12, 14, 16. This can be seen in FIG. 6.

Figure 7:
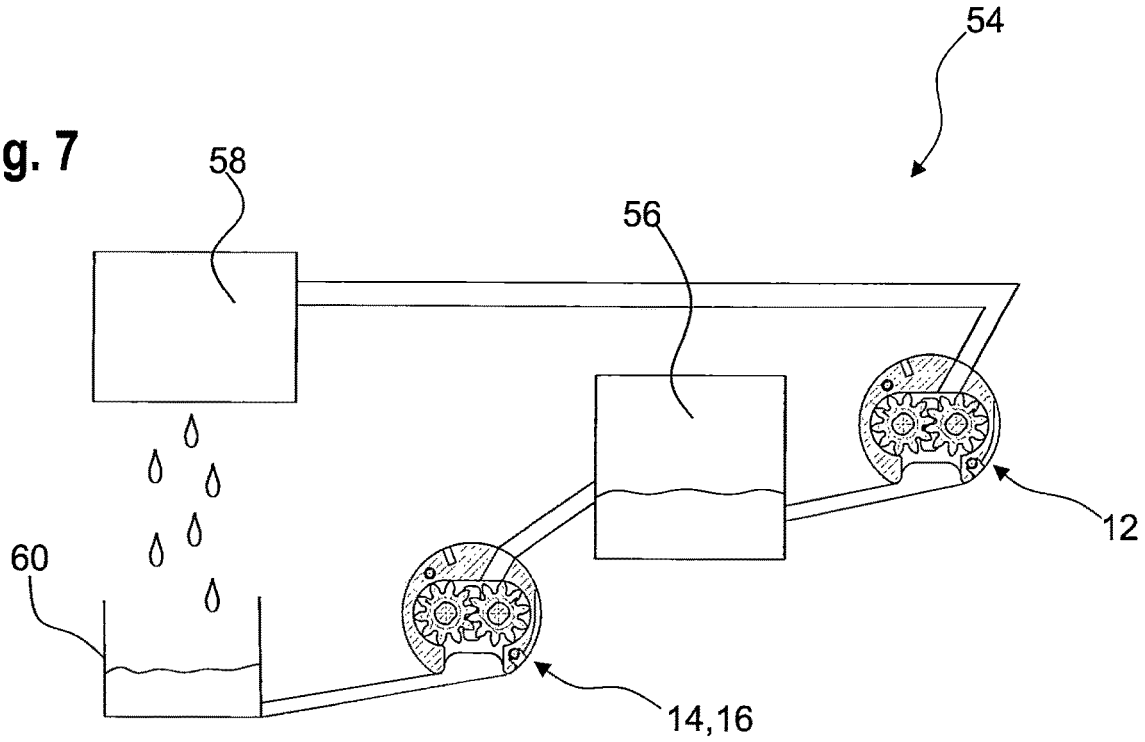
FIG. 7 shows schematically a drive machine according to the invention with a gear pump.

FIG. 7 illustrates schematically a drive machine 54 with a gear pump 10.

The functioning of a dry sump lubrication will be explained below on the basis of FIG. 7.

The drive machine 54 has an oil reservoir 56.

The gear pump 10, in particular the gear pair 12 which forms the pressure stage, draws oil out of the oil reservoir 56 and conveys this to at least one lubrication point 58 of the drive machine 54.

Oil drips into an oil sump 60 from the lubrication point 58.

By means of the gear wheel pairs 14, 16 which form the suction stages of the gear pump 10, the oil is conveyed back to the oil reservoir 56 from the oil sump.

The invention claimed is:

1. A gear pump comprising: a drive shaft; and at least two gear wheel pairs, each gear wheel pair including a drive gear wheel and a driven gear wheel, wherein the two gear wheels of each at least two gear wheel pairs are in meshing engagement with one another, wherein the drive gear wheels are arranged on the drive shaft and in torque-transmissive engagement with the drive shaft, and having a freely rotatably mounted shaft on which the driven gear wheels of each of the at least two gear wheel pairs are arranged in torque-transmissive engagement, wherein the drive shaft and the freely rotatably mounted shaft each has at least one flattening which extends in a longitudinal direction of the respective shaft, wherein the drive gear wheels and the driven gear wheels each include at least one flattening facing a corresponding one of the at least one flattenings on the drive shaft and the freely rotatably mounted shaft, and wherein a distance between the flattening on the driven gear wheels and the corresponding flattening on the freely rotatably mounted shaft have a first distance, and a distance between the flattening on the drive gear wheels and the corresponding flattening on the drive shaft have a second distance, with the first distance being greater than the second distance.

2. The gear pump according to claim 1, wherein a step is formed on the drive shaft, wherein at least one of the at least two drive gear wheels lies against the step in the longitudinal direction.

3. The gear pump according to claim 1, wherein a notch is formed in the drive shaft, wherein a locking ring is arranged in the notch and axially fixes at least one of the at least two drive gear wheels on the drive shaft.

4. The gear pump according to claim 1, wherein an end face of at least one of the at least two drive gear wheels serves as a stop for axial positioning of the drive shaft.

5. The gear pump according to claim 1, wherein the gear pump is electrically driven by means of an electric motor.

6. The gear pump according to claim 5, wherein the electric motor is accommodated in a housing and an end face of at least one of the at least two drive gear wheels lies against a flange of the housing.

7. The gear pump according to claim 1, wherein the gear wheel pairs are accommodated in a housing, wherein the housing has at least one partition wall which separates the at least two gear wheel pairs from one another in the longitudinal direction and serves as an axial stop for at least one of the at least two gear wheel pairs.

8. A drive machine for a motor vehicle having the gear pump according to claim 1 and having an oil reservoir, wherein the gear pump is configured to convey oil from the oil reservoir to lubrication points in the drive machine and to return the lubricating oil, dripping from the lubrication points, to the oil reservoir.

9. The gear pump according to claim 2, wherein a notch is formed in the drive shaft, wherein a locking ring is arranged in the notch and axially fixes at least one of the at least two drive gear wheels on the drive shaft.

10. The gear pump according to claim 1, wherein the drive gear wheels and the driven gear wheels are mounted alternately forward and backward on their respective shafts, such that teeth of adjacent gear wheels do not run in a line, such that a phase offset is achieved between the gear wheels of the adjacent gear wheel pairs.

* * * * *